US010655898B2

(12) United States Patent
Iwatsuki

(10) Patent No.: US 10,655,898 B2
(45) Date of Patent: May 19, 2020

(54) REFRIGERANT PROCESSING DEVICE AND REFRIGERATION AIR CONDITIONING SYSTEM

(71) Applicant: Kotobuki Sangyo CO., LTD., Koto-ku, Tokyo (JP)

(72) Inventor: Tadashi Iwatsuki, Iwata (JP)

( * ) Notice: Subject to any disclaimer, the term of this patent is extended or adjusted under 35 U.S.C. 154(b) by 76 days.

(21) Appl. No.: 15/776,409

(22) PCT Filed: Oct. 28, 2016

(86) PCT No.: PCT/JP2016/082133
§ 371 (c)(1),
(2) Date: May 16, 2018

(87) PCT Pub. No.: WO2017/086130
PCT Pub. Date: May 26, 2017

(65) Prior Publication Data

US 2018/0299174 A1 Oct. 18, 2018

(30) Foreign Application Priority Data

Nov. 18, 2015 (JP) ..... 2015-225306

(51) Int. Cl.
*F25B 43/00* (2006.01)
*F25B 43/04* (2006.01)
(Continued)

(52) U.S. Cl.
CPC ..... *F25B 43/00* (2013.01); *F25B 9/004* (2013.01); *F25B 13/00* (2013.01); *F25B 29/003* (2013.01);
(Continued)

(58) Field of Classification Search
CPC ..... F25B 43/00; F25B 13/00; F25B 2400/16; F25B 29/00; F25B 39/02; F25B 39/04; B01D 19/0057
See application file for complete search history.

(56) References Cited

U.S. PATENT DOCUMENTS 6,224,842 B1 5/2001 Rockenfeller et al.
2009/0188269 A1 7/2009 Attarwala et al.
2014/0374066 A1* 12/2014 Iwatsuki ..... F25B 43/043 165/104.19

FOREIGN PATENT DOCUMENTS

CN 2446463 9/2001
CN 1349605 5/2002
(Continued)

OTHER PUBLICATIONS

International Search Report dated Jan. 24, 2017 for PCT/JP2016/082133.
(Continued)

*Primary Examiner* — Elizabeth J Martin
(74) *Attorney, Agent, or Firm* — Soei Patent & Law Firm

(57) ABSTRACT

A refrigerant processing device includes a main body, and a pipe and a narrow tube that feed a refrigerant into and out of the main body. The main body has a cylindrical body part, and upper and lower end wall parts that close both ends of the cylindrical body part. The pipe passes through the lower end wall part, and extends along a central axis of the cylindrical body part. The narrow tube passes through the upper end wall part. A first spiral groove extending in a spiral shape with respect to the central axis is formed on an inner circumferential surface of the cylindrical body part. A second spiral groove extending in a spiral shape with respect to the central axis and a linear groove extending in a direction of the central axis are formed on an outer circumferential surface of the pipe.

22 Claims, 7 Drawing Sheets

(51) Int. Cl.

| | |
|---|---|
| ***F25B 47/00*** | (2006.01) |
| ***F25B 29/00*** | (2006.01) |
| ***F25B 41/06*** | (2006.01) |
| ***F25B 9/00*** | (2006.01) |
| ***F25B 13/00*** | (2006.01) |
| ***F25B 39/04*** | (2006.01) |

(52) U.S. Cl.
CPC ..... *F25B 39/04* (2013.01); *F25B 41/06* (2013.01); *F25B 41/062* (2013.01); *F25B 43/043* (2013.01); *F25B 47/00* (2013.01); *F25B 2313/02741* (2013.01); *F25B 2400/02* (2013.01); *F25B 2400/23* (2013.01); *F25B 2600/2513* (2013.01)

(56) References Cited

FOREIGN PATENT DOCUMENTS

| | | |
|---|---|---|
| CN | 102084167 | 6/2011 |
| JP | 2001-121036 | 5/2001 |
| JP | 2004-097995 | 4/2004 |
| JP | 2014-161812 | 9/2014 |
| WO | 2006/011263 | 2/2006 |
| WO | 2013/099972 | 7/2013 |

OTHER PUBLICATIONS

International Preliminary Report on Patentability with Written Opinion dated May 22, 2018 for PCT/JP2016/082133.
Extended Search Report in corresponding European Application No. 16866132.0, dated Jul. 31, 2019.

* cited by examiner

REFRIGERANT PROCESSING DEVICE AND REFRIGERATION AIR CONDITIONING SYSTEM

CROSS-REFERENCE TO RELATED APPLICATIONS

This application is a U.S. National Phase patent application of PCT Application No. PCT/JP2016/082133, filed Oct. 28, 2016 which claims the benefit of priority from Japanese Patent Application No. 2015-225306, filed Nov. 18, 2015.

TECHNICAL FIELD

This disclosure relates to a refrigerant processing device and a refrigeration air conditioning system.

BACKGROUND ART

Patent Reference 1 discloses a refrigeration air conditioning system including a compressor, an outdoor heat exchanger (also referred to as a condenser), a capillary tube, and an indoor heat exchanger (also referred to as an evaporator). The compressor, outdoor heat exchanger, capillary tube, and indoor heat exchanger are connected by piping that circulates a refrigerant. Therefore, the refrigeration air conditioning system is constituted as a closed system and the refrigerant circulates in this system while repeating gas-liquid phase transitions.

When the refrigeration air conditioning system operates as a refrigeration/air conditioning device, the indoor heat exchanger functions as an evaporator and the outdoor heat exchanger functions as a condenser. The situations of the changes in the refrigerant in this case will be explained. First, when the compressor operates, the refrigerant that is in the state of a low-temperature and low-pressure saturated vapor is condensed by the compressor and changes to a superheated vapor at high temperature and high pressure. Then, the refrigerant that is in the superheated vapor state performs a heat exchange with the surroundings of the system in the condenser and becomes a high-pressure liquid at normal temperature.

Next, the refrigerant that is in the state of a high-pressure liquid at normal temperature is expanded by the capillary tube and becomes a low-temperature and low-pressure wet vapor. Then, the refrigerant that is in the low-temperature and low-pressure wet vapor state performs a heat exchange with the surroundings of the system in the evaporator (indoor heat exchanger), absorbs the heat of the surroundings, and vaporizes completely to change to a saturated vapor. Due to the fact that the refrigerant circulates in the refrigeration air conditioning system while changing in this way, the air temperature in the room provided with the indoor heat exchanger (the evaporator) is lowered, while the heat that became high temperature and high pressure in the compressor is released outdoors, so that the air temperature outdoors provided with the outdoor heat exchanger (the condenser) rises.

Patent Reference 1 discloses a vacuum bubble removing device and the like that can remove vacuum bubbles in the refrigerant from it.

Patent Reference 2 discloses a device and the like that recombines the impurities that are present in a refrigerant or compound as a refrigerant composition. However, the device described in Patent Reference 2 is not a device that is used as a heat exchanger or part of a refrigeration air conditioning system (see paragraph 0077).

CITATION LIST

Patent Literature

Patent Literature 1: International Publication No. 2013/099972

Patent Literature 2: Japanese Unexamined Patent Publication No. 2014-161812

SUMMARY OF INVENTION

Technical Problem

In a refrigeration air conditioning system, the refrigerant circulates repeatedly inside the system in a short length of time while its temperature changes between high and low temperatures. Because of this, when the refrigeration air conditioning system is operated for a long time, radical substances and free radical molecules of the compounds (e.g., carbon, hydrogen, fluorine, and chlorine) that configure the refrigerant (below, these are simply referred to as a whole as "radicals") are produced in the refrigerant, and hydrogenated compounds such as hydrogen fluoride and hydrogen chloride may be produced by ionic bonding. When hydrogen chloride is produced in the refrigerant, rust is produced in the compressor, the outside heat exchanger, the inside heat exchangers or the refrigerant circulating system, and an expansion valve or the capillary tube may be plugged up with rust. When this happens, the expansion efficiency of the refrigerant flow passage area is lowered and the operating efficiency of the refrigeration air conditioning system may be lowered. Moreover, carbon may be liberated by itself as a free radical molecule and the operating efficiency of the refrigeration air conditioning system may be lowered.

Therefore, this disclosure explains a refrigerant processing device and a refrigeration air conditioning system that can prevent the production of hydrogenated compounds in the refrigerant and also can restore compounds constituting the refrigerant from the radicals in the refrigerant.

Solution to Problem

The refrigerant processing device according to one aspect of the present disclosure includes: a main body having a cylindrical body part, and an upper and lower end wall parts closing each end of the body part; and a pipe and a narrow tube that feed a refrigerant into the main body and feed it out of the main body. The pipe is provided in the lower end wall part to pass through it, and extends along a central axis of the body part. The narrow tube is provided in the upper end wall part to pass through it. A first spiral groove extending in a spiral shape with respect to the central axis is formed on an inner circumferential surface of the body part. A second spiral groove extending in a spiral shape with respect to the central axis and a linear groove extending in a direction of the central axis are formed on an outer circumferential surface of the pipe.

In the refrigerant processing device according to one aspect of this disclosure, the first spiral groove extending in a spiral shape with respect to the central axis is formed on the inner circumferential surface of the body part. When the refrigerant containing radicals is introduced from the narrow tube, it flows at a super high speed along the first spiral groove and a vortex is formed in the main body. The radicals flowing along with the super high-speed vortex of the refrigerant move outward, and are pressed onto the inner circumferential surface of the body part. Since the first spiral groove is provided with the inner circumferential surface of the body part, the radicals flow along the first spiral groove while contacting it. In this process, the separation of the radicals from the refrigerant, and the liquefaction of the radicals into the compounds constituting the refrigerant are promoted, and the individual radicals become easily mixed with the liquid refrigerant. Moreover, in the refrigerant processing device according to one aspect of this disclosure, the second spiral groove extending in a spiral shape with respect to the central axis is formed on the outer circumferential surface of the pipe. Therefore, since the refrigerant flows while contacting the second spiral groove, the very high-speed vortex is formed still more easily. Therefore, even when radicals are not separated by the first spiral groove, the radicals move outward due to the flow of the refrigerant containing the radicals on the outer circumferential surface of the pipe, and the radicals are pressed onto the inner circumferential surface of the body part. Since the radicals are again separated in the first spiral groove, the radicals are reliably removed from the refrigerant. Furthermore, in the refrigerant processing device according to one aspect of this disclosure, a linear groove extending in the direction of the central axis is formed on the outer circumferential surface of the pipe. Therefore, the liquefaction of the radicals to the refrigerant is still more promoted and the second spiral groove can be formed simply and at low cost. As a result of the above, the radicals in the refrigerant can be restored into compounds constituting the refrigerant.

The depth of the linear groove may be smaller than the thickness of the second spiral groove.

An inner end part of the narrow tube located in the main body may be bent, and an opening of the inner end part may be directed toward the inner circumferential surface of the body part.

The first spiral groove may extend the whole length of the body part, and the pitch of the first spiral groove at the side of the upper end wall part may be smaller than the pitch of the first spiral groove at the side of the lower end wall part in this case, the radicals contact the first spiral groove for a long time. Therefore, the separation of the radicals from the refrigerant and the liquefaction of the radicals into compounds constituting the refrigerant are more promoted, and the radicals become more easily mixed with the liquid refrigerant. Therefore, the radicals in the refrigerant are easily restored into compounds constituting the refrigerant.

The refrigerant processing device according to one aspect of this disclosure may further comprise a coil spring installed along the inner circumferential surface of the body part, and the first spiral groove may be formed by the gap with adjacent metal wire portions of the coil spring. In this case, the first spiral groove can be formed simply and at low cost by using a coil spring.

A throttling member having a smaller flow path area than the flow path area of the pipe may be provided within the pipe. In this case, the pressure on the downstream side of the throttling member becomes lower than that on the upstream side of the throttling member. Therefore, since the force from the refrigerant that acts on the radical aggregates is relatively lower, the liquefaction of the radicals proceeds more easily. As a result, the liquefaction of the radicals in the refrigerant into compounds constituting the refrigerant can be further promoted.

The refrigeration air conditioning system according to another aspect of the present disclosure includes: an indoor heat exchange device; a compressor that is connected to the indoor heat exchange device by piping and compresses the refrigerant fed into it; an outdoor heat exchanger that is connected to the compressor by piping; the aforementioned refrigerant processing device that is connected to the outdoor heat exchange device by piping; and an expander that is connected to the refrigerant processing device and the indoor heat exchange device by piping and expands the refrigerant fed into it. In the refrigeration air conditioning system according to another aspect of this disclosure, the radicals in the refrigerant can be restored to compounds constituting the refrigerant, similarly to the aforementioned refrigerant processing device. Therefore, the production of hydrogenated compounds is suppressed and rust is prevented from being produced in the compressor, the outdoor heat exchange device, the indoor heat exchange device, or the refrigerant circulating system. Therefore, the operating efficiency of the refrigeration air conditioning system is improved and a reduction of the power consumption and a reduction in the emission amount of carbon dioxide can be promoted.

Advantageous Effects of Invention

According to the refrigerant processing device and the refrigeration air conditioning system of this disclosure, the production of hydrogenated compounds in the refrigerant can be prevented and compounds constituting the refrigerant can be restored from the radicals in the refrigerant.

DESCRIPTION OF EMBODIMENTS

Embodiments of a refrigeration air conditioning system 1 according to the present disclosure will be explained with reference to the drawings. In the following description, the same elements or the elements having the same functions are denoted with the same sings and an overlapping description thereof will be omitted.

Figure 1:
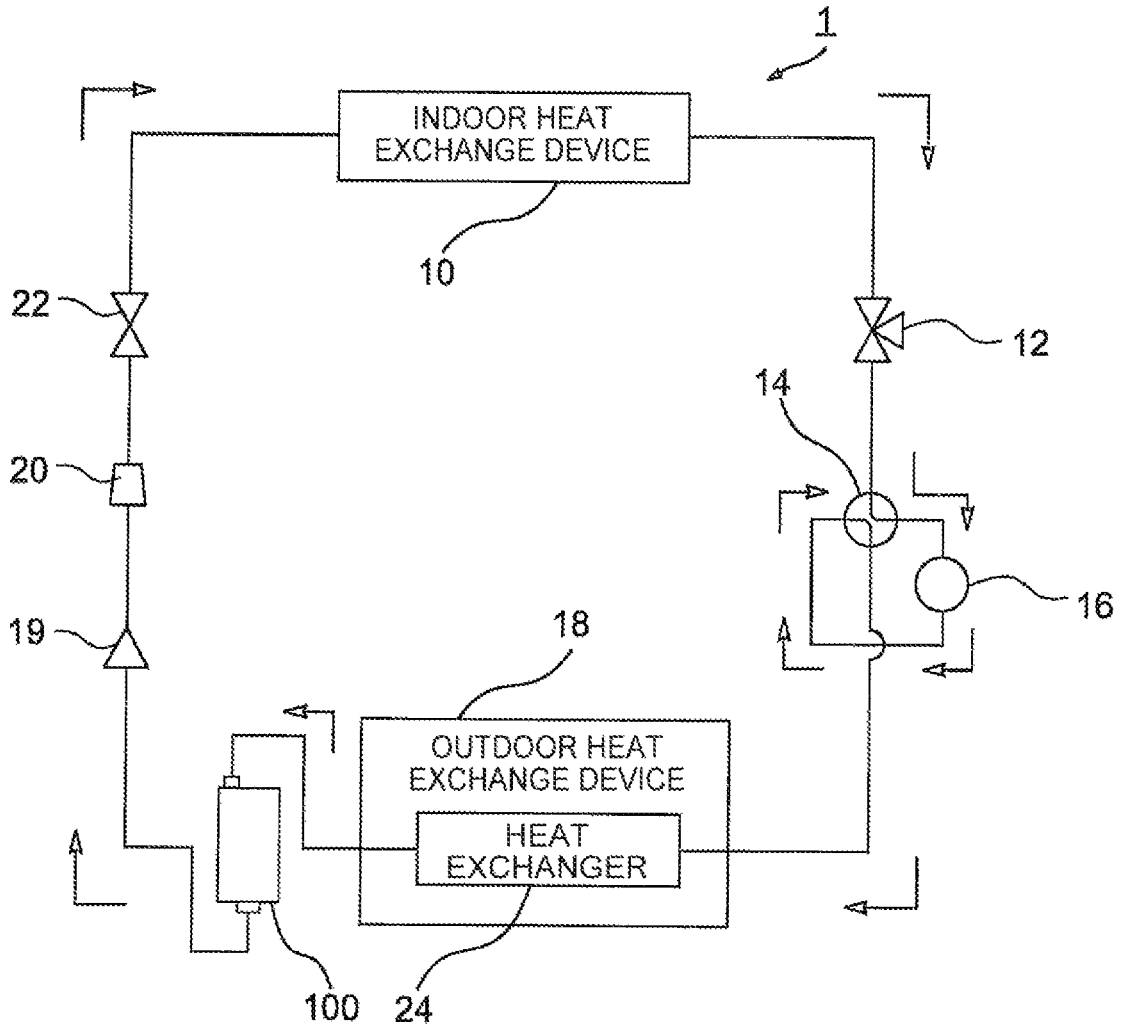
FIG. 1 is a view of the example in which a refrigeration air conditioning system according to an embodiment is used as a refrigeration/cooling device.

The refrigeration air conditioning system 1 is used as an air conditioner for homes or offices, a refrigerating apparatus, or a freezer. The air conditioner includes a room air conditioner and an automotive air conditioner, for example. As shown in FIG. 1, the refrigeration air conditioning system 1 includes an outdoor heat exchange device 10, a three-way valve 12, a four-way valve 14, a compressor 16, an outdoor heat exchange device 18, a refrigerant processing device 100, an expansion valve 19 (an expander), a capillary tube 20 (an expander), and a two-way valve 22.

The outdoor heat exchange device 10, three-way valve 12, four-way valve 14, compressor 16, outdoor heat exchange device 18, refrigerant processing device 100, expansion valve 19, capillary tube 20, and two way valve 22 are connected in this order by piping so that a refrigerant is circulated therethrough. Therefore, the refrigeration air conditioning system 1 is constituted as a closed system in which a refrigerant circulates.

For example, the kind of refrigerant includes CFC, HCFC, HCF, or other refrigerant mixture. The CFC includes R-11, R-12, R-13, R-114, R-115, and R-502, for example. The HCFC includes R-22, R-123, R-123a, R-124, R-141b, R-142b, R-225aa, R-225ba, R-225bb, R-225ca, R-225cb, R-225cc, R-401A, R-401B, R-401C, R-408A, R-409A and R-409B, for example. The HCF includes R-23, RR-32, R-125, R-134a, R-152a, R-227ea, R-236fa, R-245cb, R-R-245ca, R-245fa, R-404A, R-407A, R-407B, R-407C, R-407D, R-407E, R-410A, R-410B, R-413a and R-507A, for example. The other refrigerant mixture includes R-14, R116, R-218, R-245cb, R-245mc, R-290, R-402A, R-402B, R-403A, R-403B, R-405A, R-406, R-411A, R-411B, R-412A, R-508A, R-508B, R-509A, R-600, R-600a, R-702, R-704, R-717, R-718, R-720, R-728, R-740, R-732, R-744, R-744A, R-764, R-1114, R-1270 and R-C318, for example.

The indoor heat exchanger 10 is provided inside a room in which cooling, heating, or freezing is performed. The indoor heat exchanger 10 includes a not shown heat exchanger which performs heat exchange between the refrigerant flowing in the heat exchanger and inside of the room (the outside environment of the refrigeration air conditioning system 1) so as to adjust an indoor temperature.

The four-way valve 14 switches the refrigerant flow direction between forward and reverse so that the operation state of the refrigeration air conditioning system 1 is changed to cooling or heating. The compressor 16 compresses the refrigerant to change it to a high-temperature and high-pressure state.

The outdoor heat exchange device 18 is provided in the space (for example, outdoor) different from the indoor space where the indoor heat exchange device 10 is provided. The outdoor heat exchange device 18 includes a heat exchanger 24. The heat exchanger 24 performs heat exchange between the refrigerant flowing in the heat exchanger 24 and the space (the outside environment of the refrigeration air conditioning system 1).

Figure 3:
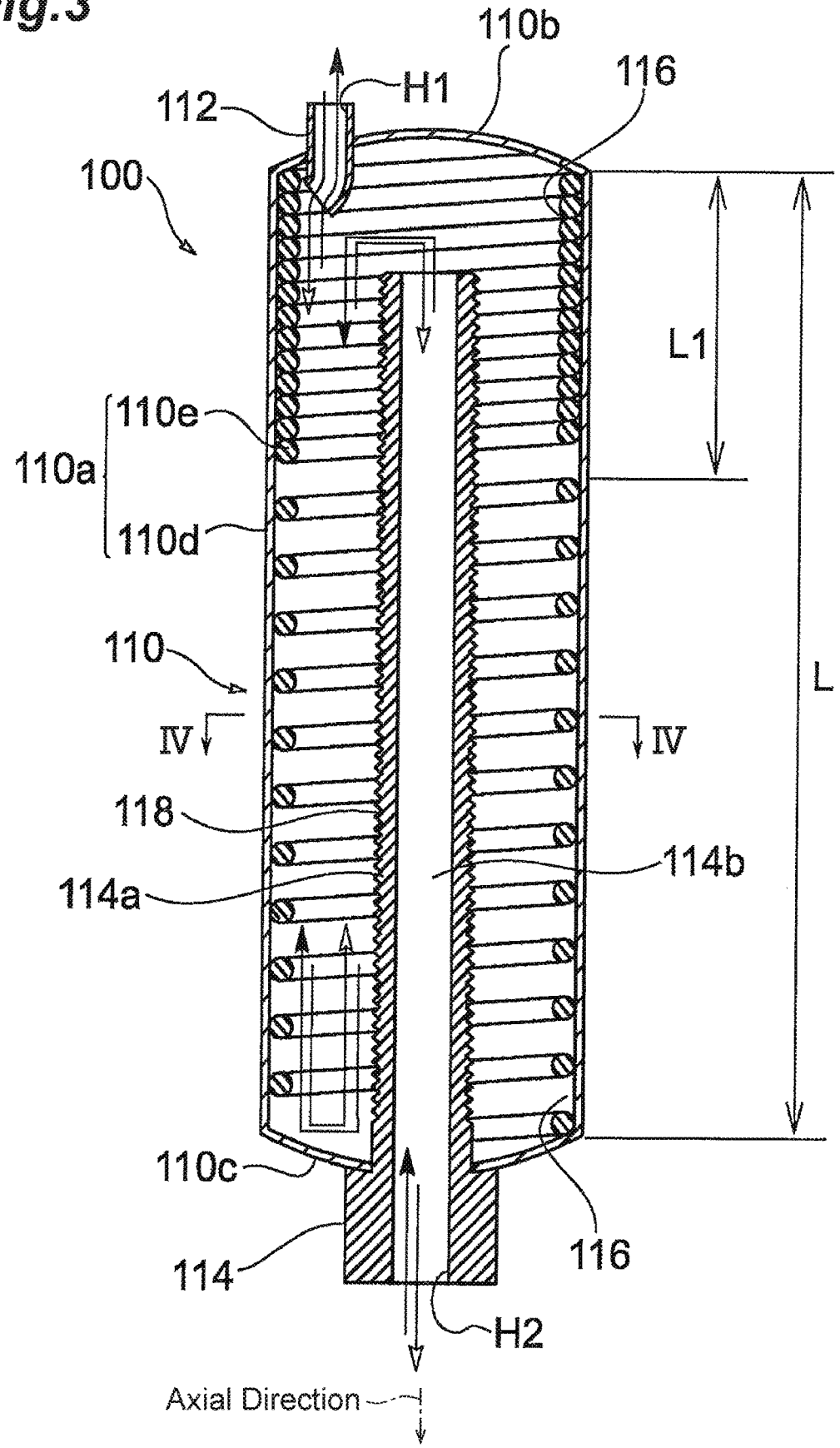
FIG. 3 is a cross-sectional view in which the refrigerant processing device according to an embodiment is cut along a plane passing through the central axis of the main body.

The refrigerant processing device 100, as shown in FIG. 3, includes a main body 110, a narrow tube 112, and a pipe 114. The main body 110 includes a body part 110*a*, and upper and lower end wall parts 110*b*, 110*c* for closing both end parts of the body part 110*a*.

The body part 110*a* includes a cylindrical tube 110*d* and a cylindrical coil spring 110*e*. The length and diameter of the tube 110*d* may be set according to the horsepower (capacity of the refrigeration air conditioning system 1). For example, when the refrigeration air conditioning system 1 is an industrial air conditioner, the length of the tube 110*d* may be about 8 cm to 27 cm and the inner diameter of the tube 110*d* may be about 6.5 cm to 25 cm. When the refrigeration air conditioning system 1 is a home air conditioner, the length of the tube 110*d* may be about 4 cm to 6.5 cm and the inner diameter of the tube 110*d* may be about 3.4 cm to 6.5 cm. The cylindrical coil spring 110*e* is attached on the inner wall surface of the tube 110*d*. Therefore, the inner circumferential surface of the body part 110*a* includes a spiral groove 116 (first spiral groove) that extends in a spiral shape with respect to the central axis of the body part 110*a* (below, referred to as the "central axis"). That is, in this embodiment, the spiral groove 116 is formed by a gap of adjacent metal wire portions of the cylindrical coil spring 110*e*.

As shown in FIG. 3, a cross section of this metal wire is circular. A diameter of the metal wire may be about 2 mm to 8 mm, and it may be about 4 mm. When the refrigeration air conditioning system 1 is a home air conditioner, the diameter of this metal wire may be about 2 mm. The inner circumferential surface of the body part 110*a* (the spiral groove 116) is separated from the outer circumferential surface of the pipe 114. Therefore, a flow passage through which the refrigerant flows is formed between the inner surface of the body part 110*a* and the outer peripheral surface of the pipe 114. The inner surface of the body part 110*a* exhibits an irregular surface on which projections and depressions are arranged side by side along the flow passage (in a direction facing the upper and lower end parts 110*b*, 110*c*) due to the presence of the spiral groove 116.

In this embodiment, the full length of the cylindrical coil spring 110*e* is substantially equal to the full length of the tube 110*d*. Therefore, the spiral groove 116 exists across the full length of the body part 110*a*. As shown in FIG. 3, in this embodiment, a pitch of the spiral groove 116 on the side of the narrow tube 112 is narrower than the pitch of the spiral groove 116 on the side distant from the narrow tube 112 (on the side of the pipe 114). Assuming that a full length of the spiral groove 116 (the cylindrical coil spring 110*e*) in the center axis direction is L, and a length of the part of the spiral groove 116 on the side of the narrow tube 112 where the pitch is narrower is L1, the inequality $L1/L \geq 1/3$ may be satisfied, $1/3 \leq L1/L \leq 2/3$ may be satisfied, or $1/3 \leq L1/L \leq 1.5/3$ may be satisfied.

The upper end wall part 110*b* and the lower end wall part 110*c* are formed by shallow disk-shaped caps. The narrow tube 112 including an opening H1 is provided on the peripheral side of the upper end wall part 110*b*. In other words, the central axis of the narrow tube 112 is offset with respect to the central axis of the body part 110*a*. The end part of the narrow tube 112 inside the main body 110 (the inner end part) is bent. This end part is directed toward the inner circumferential surface of the body part 110*a*. The narrow tube 112 is attached on the upper end wall part 110*b* so as to communicate with the inside of the main body 110. The pipe 114 including an opening H2 is provided at the vicinity of the center of the lower end wall part 110*c*. The pipe 114 is attached on the lower end wall part 110*c* so that one end thereof is located inside the main body 110 (inside the body part 110*a*) while being inserted into the lower end wall part 110*c*. Therefore, the opening H1 of the narrow tube 112 and the opening H2 of the pipe 114 do not face each other when seen in the central axis direction.

As shown in FIG. 3, a male screw is formed in the outer circumferential surface of the inner pipe part 114*a* that is a part of the pipe 114 located inside the main body 110 (inside the body part 110*a*). That is, the male screw forms the spiral groove 118 (a second spiral groove) by means of a male screw extending spirally with respect to the central axis in the outer circumferential surface of the inner pipe part 114*a* of the pipe 114. The winding direction of the spiral groove 118 of the inner pipe part 114*a* of the pipe part 114 is the same as that of the cylindrical coil spring 110*a*.

Figure 4:
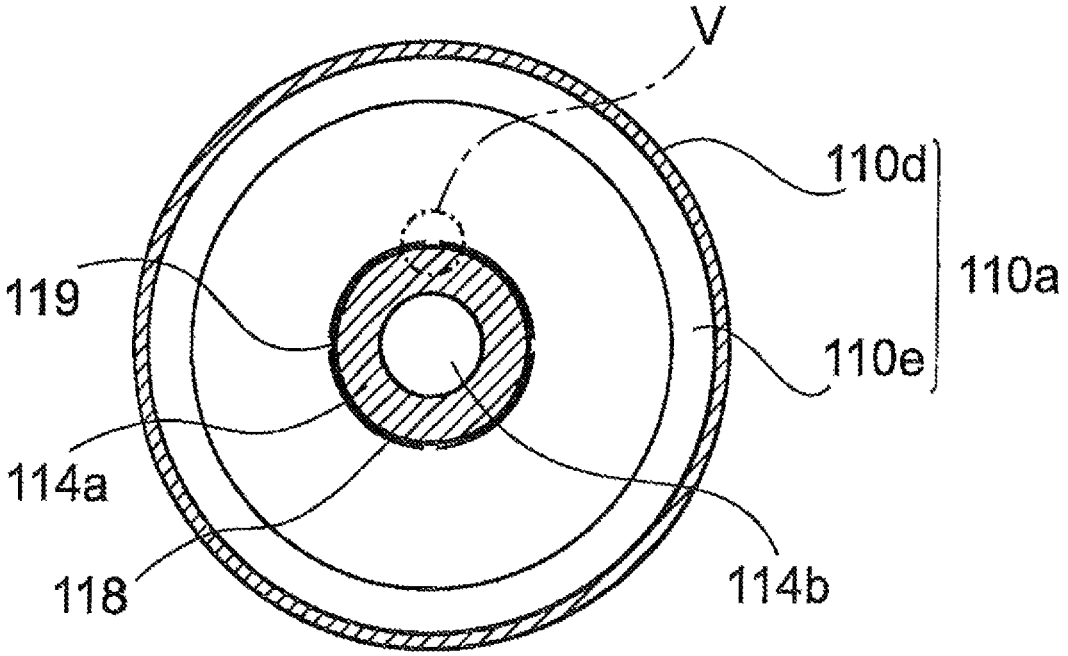
FIG. 4 is a cross-sectional view at the line IV-IV in FIG. 3.
Figure 5:
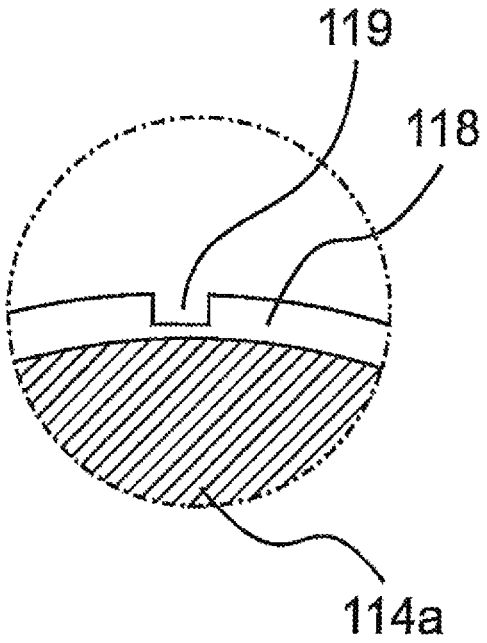
FIG. 5 is an enlarged view of the part V enclosed by a dot-and-dash line in FIG. 4.

As shown in FIGS. 4 and 5, a linear groove 119 extending in the axial direction is formed in the outer circumferential surface of the inner pipe part 114*a* of the pipe 114 so as to intersect the spiral groove 118. The linear groove 119 has the depth shallower than the depth of the spiral groove 118 formed by the male screw. That is, the bottom surface of the linear groove 119 is outside the bottom surface of the groove of the male screw. Therefore, part of the spiral groove 118 formed by the male screw is formed on the bottom surface of the linear groove 119.

Referring back to FIG. 1, the capillary tube 20 is used to cause adiabatic expansion in the refrigerant so that a part of the refrigerant is changed from liquid to gas, and functions equivalently as an expansion valve. Therefore, the cross sectional area (flow passage area) of the capillary tube 20 is smaller than the cross sectional area (flow passage area) of the other piping.

Next, operation of the above-described refrigeration air conditioning system 1 serving as an air-conditioning device will be explained with reference to FIGS. 1 and 3. In FIGS. 1 and 3, the flow of the refrigerant in the case where the refrigeration air conditioning system 1 operates as an air conditioning device is shown by the white arrows. At this time, the heat exchanger of the indoor heat exchange device 10 functions as an evaporator, and the heat exchanger 24 of the outdoor heat exchange device 18 functions as a condenser.

The compressor 16 is operated to compress the refrigerant in the low temperature and low pressure saturated vapor state so as to change the state to the high pressure superheated vapor state. Then the refrigerant in the superheated vapor state exchange heat with the outside environment by the heat exchanger 24 of the outdoor heat exchange device 18, so that the refrigerant is changed into liquid in the normal temperature and high pressure state. At this time, the entire refrigerant is sometimes not changed into liquid completely, resulting in radicals in the liquid refrigerant. The liquid refrigerant containing radicals, together with the radicals, flows from the heat exchanger 24 of the outdoor heat exchange device 18 into the refrigerant processing device 100 through the narrow tube 112 (the opening H1).

When the refrigerant flows into the refrigerant processing device 100, it flows while colliding with the spiral groove 116 at an ultra-high speed. Therefore, an ultra-high-speed vortex of the refrigerant is formed in the main body 110. As a result, the radicals that flow accompanying the ultra-high-speed vortex of the refrigerant move outward, and are pressed to the inner circumferential surface of the body part 110*a*. Because the spiral groove 116 is formed on the inner circumferential surface of the body part 110*a*, the radicals flow along the spiral grove 116 while in contact therewith. In this process, the separation of the radicals from the refrigerant and the liquefaction of the radicals into compounds constituting the refrigerant are promoted.

The refrigerant flowing along the spiral groove 116 on the inner surface of the body part 110*a* impinges against the lower end wall part 110*c*, by which the flowing direction is reversed. It then flows toward the upper end wall part 110*b* along the outer circumferential surface of the pipe 114. That is, the refrigerant flows in contact with the spiral groove 118, and thus, the very high-speed vortex of the refrigerant is generated also by the spiral groove 118. Even if there exist the radicals that could not be separated in the spiral groove 116, they are likely to move outward (toward the spiral groove 116) when the refrigerant containing the radicals flows again to the outer circumferential surface of the pipe 114. As a result, since the radicals are again separated from the refrigerant in the spiral groove 116, the radicals are reliably removed from the refrigerant and the liquefaction of the radicals into compounds constituting the refrigerant is further promoted. In this way, the function of the refrigerant is restored.

When the refrigerant flows to the end of the pipe 114, the end being in the main body 110, the refrigerant impinges against the upper end wall part 110*b*, by which the flowing direction is reversed. It then flows from the opening of the end of the pipe 114 into the flow passage 114*b* in the pipe 114. Therefore, the liquid refrigerant restored by the separation of the radicals and in the normal temperature and high pressure state flows out from the opening H2 of the pipe 114 (refer to the hollow arrowheads in FIG. 3).

Next, the liquid refrigerant in the normal temperature and high pressure state is expanded by the capillary tube 20 into the wet vapor in the low temperature and low pressure state. Then, the refrigerant in the low temperature and low pressure wet vapor state exchanges heat with the outside environment by the heat exchanger of the indoor heat exchange device 10, so that heat of the outside environment is absorbed. It is then completely evaporated, and changed into a saturated vapor.

Thus, the refrigerant flows through the compressor 16, the four-way valve 14, the outdoor heat exchange device 18 (heat exchanger 24), the refrigerant processing device 100, the expansion valve 19, the capillary tube 20, the two-way valve 22, the indoor heat exchange device 10, the three-way valve 12, and the four-way valve 14 in this order, and circulates in the refrigeration air conditioning system 1. As the refrigerant circulates in the refrigeration air conditioning system 1 while changing as described above, the air temperature inside the room in which the evaporator (the indoor heat exchange device 10) is installed is decreased, while the outdoor air temperature where the condenser (the outdoor heat exchange device 18) is installed is increased.

Figure 2:
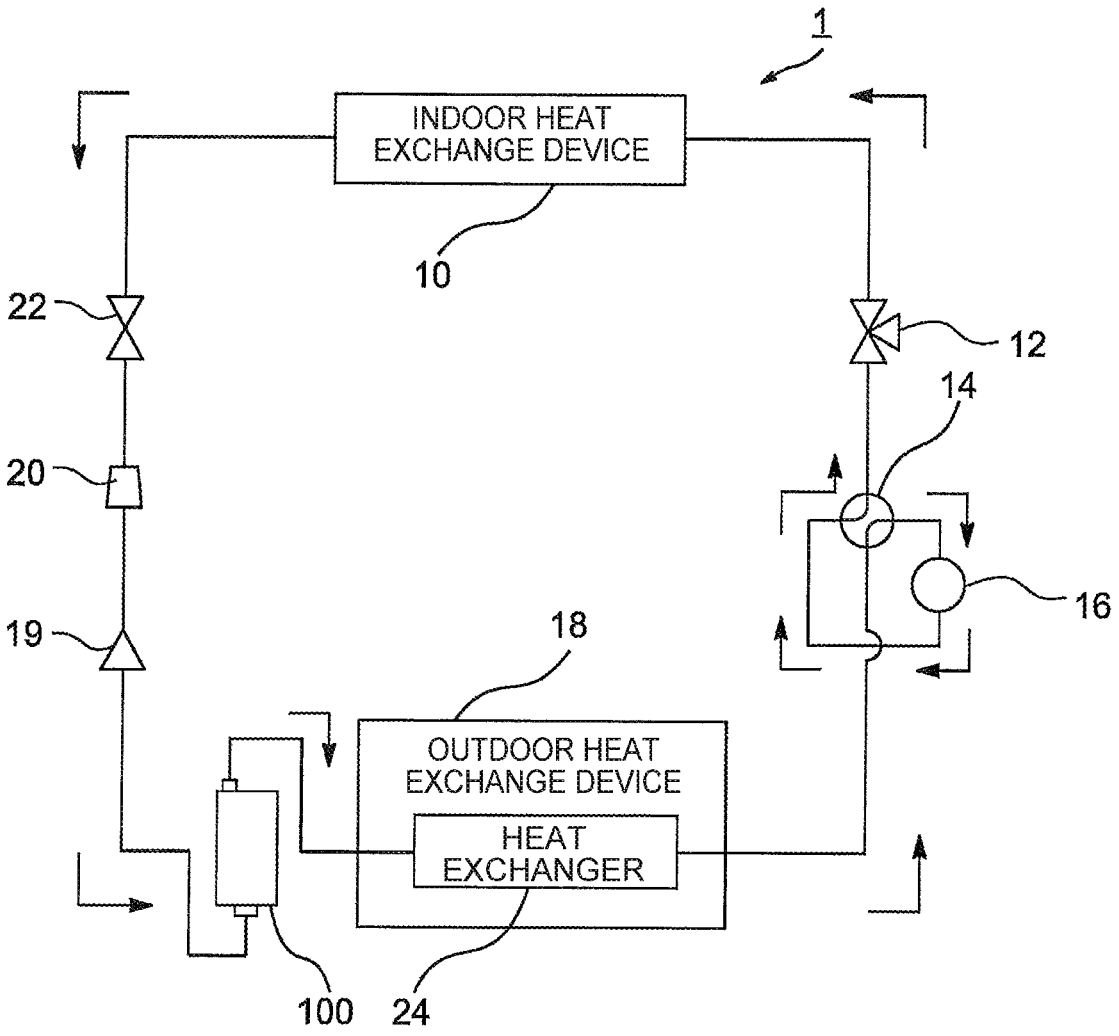
FIG. 2 is a view of the example in which the refrigeration air conditioning system according to an embodiment is used as a heating device.

Next, referring to FIGS. 2 and 3, the operation of the refrigeration air conditioning system 1 as a heating device will be described. In FIGS. 2 and 3, the flow of the refrigerant in the case where the refrigeration air conditioning system 1 operates as a heating device is shown by the black arrows. At this time, the heat exchanger of the indoor heat exchange device 10 functions as a condenser, and the heat exchanger 24 of the outdoor heat exchange device 18 functions as an evaporator.

The compressor 16 is operated to compress the refrigerant in the low temperature and low pressure dry vapor state so as to be changed into the high temperature and high pressure superheated vapor. Then, the refrigerant in the superheated vapor state flows into the indoor heat exchange device 10 in the order of the four-way valve 14 followed by the three-way valve 12, and exchanges heat with the outside environment at the heat exchanger of the indoor heat exchange device 10, so that the refrigerant is changed into the normal temperature and high pressure liquid.

Next, the refrigerant in the normal temperature and high pressure liquid state is expanded by the expansion valve 19 and the capillary tube 20 into the low temperature and low pressure wet vapor. Next, the refrigerant in the low temperature and low pressure wet vapor state flows into the refrigerant processing device 100 and its function is restored. After this, it is heated through heat exchange by the outdoor heat exchange device 18, and changed into a normal low temperature gas.

Thus, the refrigerant flows through the compressor 16, the four-way valve 14, the three-way valve 12, the indoor heat exchange device 10, the two-way valve 22, the expansion valve 19, the capillary tube 20, the refrigerant processing device 100, the outdoor heat exchange device 18 (the heat exchanger 24), and the four-way valve 14 in this order, and circulates in the refrigeration air conditioning system 1. As the refrigerant circulates in the refrigeration air conditioning system 1 while changing as described, the air temperature inside the room in which the evaporator (the indoor heat exchange device 10) is installed is increased, while the outdoor air temperature where the condenser (the outdoor heat exchange device 18) is installed is decreased.

In the embodiment described above, the inner circumferential surface of the body part 110*a* includes the spiral groove 116 extending in a spiral shape with respect to the central axis. In the process in which the gas/liquid refrigerant containing radicals flows while colliding with the spiral groove 116, the separation of the radicals from the refrigerant is promoted, and each radical is changed into the liquid refrigerant in the refrigerant composition. Therefore, the separation of the radicals in the refrigerant from the refrigerant and the liquefaction of the radicals into the refrigerant composition are promoted. As a result, the radicals in the refrigerant can be restored into compounds constituting the refrigerant.

In this embodiment, the spiral groove 116 extends the whole length of the body part 110*a*. Therefore, the radicals contact the spiral groove 116 for a long time. Consequently, the separation of the radicals from the refrigerant and their regeneration into the refrigerant are promoted.

In this embodiment, the spiral groove 116 is configured by the gap of the adjacent metal wire portions of the cylindrical coil spring 110*e*. Therefore, the spiral groove 116 can be formed simply and at low cost by using the cylindrical coil spring 110*e*.

In this embodiment, the opening H1 of narrow tube 112 and the opening H2 of pipe 114 are not opposite each other when viewed from the central axis direction. Therefore, the refrigerant is less likely to flow directly from the opening H1 of narrow tube 112 to the opening H2 of pipe 114. According to this configuration, the separation of the refrigerant and the refrigeration machine oil is prevented so that the refrigeration machine oil flowing together with the refrigerant is not pooled in pipe 114. Therefore, the refrigerant and the refrigeration machine oil (lubricating oil) flow into the opening H2 of pipe 114 in the best mixture ratio. Moreover, the refrigerant that has flowed from narrow tube 112 into the main body 110 collides with the spiral groove 116 (the cylindrical coil spring 110*e*) at the super high speed, and therefore the efficiency of the gas/liquid separation is enhanced.

In this embodiment, the outer circumferential surface of the inner pipe part 114*a* of the pipe 114 includes the spiral groove 118 extending in a spiral shape with respect to the central axis, and the linear groove 119. Therefore, because the refrigerant flows while contacting the spiral groove 118 and the linear groove 119, the super high-speed vortex is formed still more easily. Consequently, the radicals move outward easily and the separation of the radicals is promoted still more.

In this embodiment, the spiral groove 118 is formed by the male screw. Therefore, the spiral groove 118 can be formed simply and at low cost.

In this embodiment, the linear groove 119 extending in the central axis direction is formed on the outer circumferential surface of the pipe 114. Therefore, the liquefaction of the radicals into the refrigerant composition is still further promoted and the spiral groove 118 can be formed simply and at low cost.

Incidentally, when the operation of the refrigeration air conditioning system 1 is stopped, a small quantity of liquid refrigerant may pool at the bottom of the main body 110 near the lower end wall part 110*c*. When the operation of the refrigeration air conditioning system 1 is restarted in this state, energy is needed to push the liquid pooled on the lower end wall part 110*c* upward. In this embodiment, however, a linear groove 119 extending in the axial direction is formed on the outer circumferential surface of the inner pipe part 114*a* of the pipe 114. Therefore, the liquid refrigerant easily flows upward along the linear groove 119. Consequently, the energy needed to push the liquid refrigerant upward can be reduced, and energy saving can be achieved.

Incidentally, if the depths of the linear groove 119 and the spiral groove 118 are the same, the liquid refrigerant will flow and be mixed together with the refrigerant containing the radicals when the liquid refrigerant moves upward along the linear groove 119 because the refrigerant containing radicals flows in the spiral groove 118. In this case, although there is no need to mix the liquid refrigerant, unnecessary energy will be consumed in the liquid refrigerant. However, in this embodiment, the depth of the linear groove 119 is smaller (shallower) than the depth of the spiral groove 118. Therefore, the refrigerant containing radicals and flowing in the spiral groove 118 is less likely to act on the liquid refrigerant flowing in the linear groove 119. Consequently, the energy needed to push the liquid refrigerant upward can be reduced further, and more energy saving can be achieved.

The refrigeration air-conditioning system 1 in this embodiment can be formed by adding the refrigerant processing device 100 to existing refrigeration air conditioning systems. Therefore, the operating efficiency of the whole refrigeration air-conditioning system 1 can be raised by merely adding the refrigerant processing device 100, and this can contribute greatly to energy savings. Moreover, in adding the refrigerant processing device 100, it is not necessary to change the refrigerants in the existing refrigeration air conditioning systems, even in kinds of systems in which the air conditioning performance has declined.

The preferred embodiment of this disclosure has been described in detail, but various modifications may be made to this embodiment within the scope of this invention. For example, the spiral groove 116 was configured in this embodiment by the cylindrical coil spring 110*e*, but the spiral groove may also be formed directly in the inner wall surface of the tube 110*d*. Various forms may be employed for the cross sectional form of the groove, such as a U-shaped, triangular, quadrilateral, or other irregular shape.

In this embodiment, the spiral groove 116 has approximately the same length as the whole length of the tube 110*d*, but the inner surface of the body part 110*a* may have the spiral groove 116 on at least the side of the opening H1 of the narrow tube 112 through which the refrigerant flows in and out.

In this embodiment, the tube 110*d* had a cylindrical form, but various forms may be employed for the form of barrel 110*d*, including polygonal forms such as a hexagonal or quadrangular forms, or an elliptical form, etc.

Various forms may be employed for the cross sectional form of the metal wire of the cylindrical coil spring 110*e* in this embodiment, such as a circular, rectangular, etc.

In this embodiment, the spiral groove 118 of the pipe 114 is configured by the male screw, but it may be configured by winding a metal wire in spiral form on the outer circumferential surface of the pipe 114 and structuring the spiral groove by the gap with the adjacent metal wire portions. The pipe 114 may not include the spiral groove 118.

The pitches of the spiral grooves 116 and 118 may also be constant along the direction of the central axis or they may vary.

Figure 6:
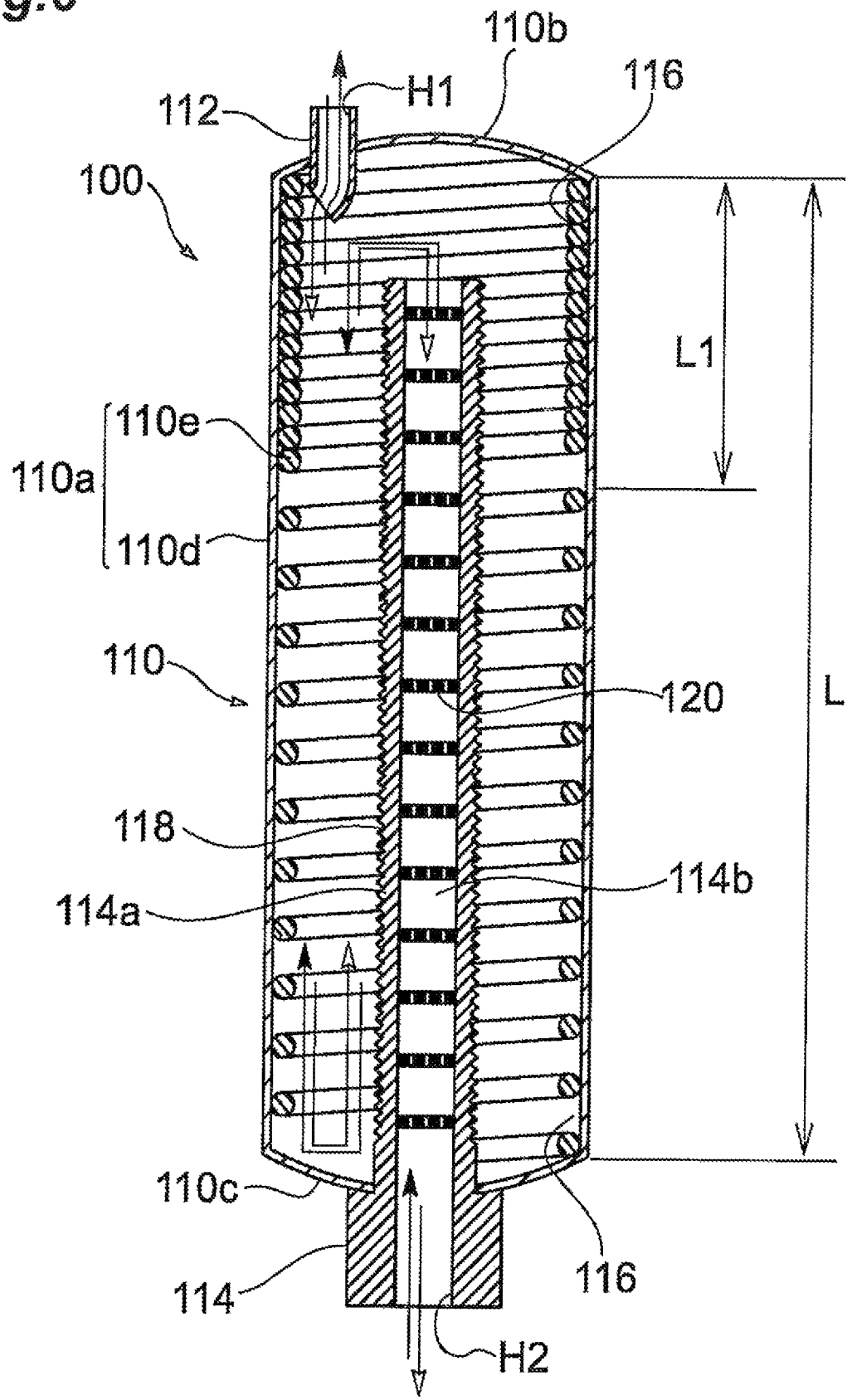
FIG. 6 is a cross-sectional view in which a refrigerant processing device according to another embodiment is cut along a plane passing through the central axis of the main body.

As shown in FIG. 6, throttling members 120 may also be provided in the pipe 114. In the example shown in FIG. 6, fourteen throttling members 120 with flat plate shapes are provided in the pipe 114. The number of throttling members 120 in the pipe 114 may be approximately 5-15, or may be at least one.

Figure 7:
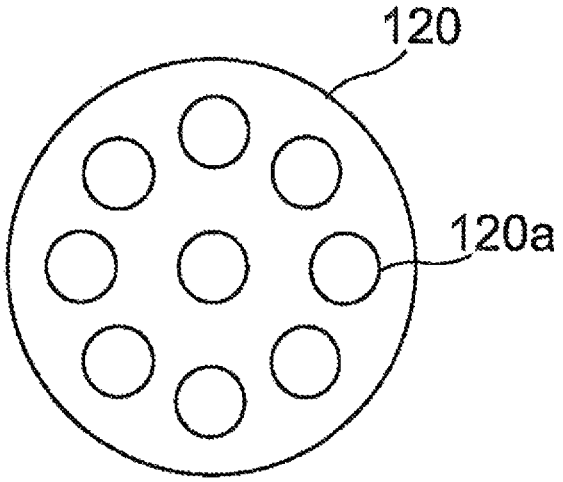
FIG. 7 is a top view of a throttling member provided within the refrigerant processing device according to another embodiment.

The throttling members 120 may provide a smaller flow passage area than the flow passage area of the pipe 114. The flow passage area provided by the throttling members 120 may be set so as not to exert the load to the compressor 16 located upstream of the throttling members 120, or the load is substantially negligible under the condition of increasing pressure at the upstream side due to the existence of the throttling members 120. The flow passage area provided by the throttling members 120 may be set to approximately ⅔ to ¾ of the flow passage area provided by the pipe 114. The shape of the throttling members 120 is not limited to a flat plate shape. It may employ a variety of shapes. If the throttling members 120 have the flat plate shape, at least one through-hole 120*a* (FIG. 7 shows nine through-holes 120*a*) penetrating in the thickness direction may be formed, as shown in FIG. 7.

The throttling members 120 serves to make the pressure at the downstream side of the throttling members 120 lower than that at the upstream side of the throttling members 120. Therefore, the force from the refrigerant acting on an aggregation of the radicals is made relatively low. Therefore, the separation of the radicals from the refrigerant and the liquefaction of the radicals into the refrigerant composition can further be promoted.

Example 1

The present invention will be described in more detail based on Examples 1-1 and 1-2 and Comparative Examples 1-1 and 1-2. However, the present invention is not limited to the following examples.

Example 1-1

First, the refrigeration air conditioning system 1 according to this embodiment was prepared. FZ285X manufactured by Daikin Industries, Ltd. was used as the indoor heat exchange device 10. RAZ285XE manufactured by Daikin Industries, Ltd. was used as the outdoor heat exchange device 18. R-22 was used as the refrigerant.

Next, as shown in FIG. 1, the refrigeration air conditioning system 1 serving as an air conditioner was operated for 60 minutes under the following conditions. The indoor temperature and the outlet temperature of the indoor heat exchange device measured 24° C. for 18 minutes from start of the operation. The indoor relative humidity measured 55% RH for 30 minutes from start of the operation.

Indoor temperature: 26.5° C.

Indoor relative humidity: 67% RH

Outdoor air temperature: 28.5° C.

Outlet temperature of the indoor heat exchange device: 24° C.

After the operation, the pressure at the inlet side of the compressor 16 (on the side of the indoor heat exchange device) and the pressure at the outlet side of the compressor 16 (on the side of the outdoor heat exchange device) were measured to obtain the following measurement results. Moreover, Power consumption per hour of the compressor 16 was measured with a measurement instrument (Watt Checker (watt meter) DW-777 manufactured by Edenki Co.) to obtain the following measurement results.

Pressure at the inlet side of the compressor (on the side of the indoor heat exchange device): 0.28 MPa Pressure at the outlet side of the compressor (on the side of the outdoor heat exchange device): 1.43 MPa Power consumption per hour of the compressor: 885 Wh/h After the operation, the refrigerant at the outlet of the outdoor heat exchange device 18 was fed to a heat-resistant glass level gauge, and illuminated by an LED (light-emitting diode) for visually checking the bubble in the refrigerant by using a liquid pipe side glass placed in the piping. No bubble was confirmed.

Comparative Example 1-1

The refrigeration air conditioning system was prepared in the same way as in Example 1-1 except that the refrigerant processing device 100 was not provided. The refrigeration air conditioning system 1 serving as the air conditioner was operated for 60 minutes under the same conditions as those of Example 1-1, and the indoor temperature and the outlet temperature of the indoor heat exchange device measured 24° C. for 22 minutes from start of the operation.

After the operation, the pressure at the inlet side of the compressor (on the side of the indoor heat exchange device), the pressure at the outlet side of the compressor (on the side of the outdoor heat exchange device), and power consumption per hour of the compressor were measured to obtain the following measurement results.

Pressure at the inlet side of the compressor (on the side of the indoor heat exchange device): 0.37 MPa Pressure at the outlet side of the compressor (on the side of the outdoor heat exchange device): 1.81 Mpa Power consumption per hour of the compressor: 1320 Wh/h After the operation, the refrigerant at the outlet of the outdoor heat exchange device was fed to the heat-resistant glass level gauge, and illuminated by the LED (light-emitting diode) for visually checking the bubble in the refrigerant. The gaseous phase of approximately 25% was confirmed.

Example 1-2

The refrigeration air conditioning system 1 according to this embodiment was prepared. FZ285X manufactured by Daikin Industries, Ltd. was used as the indoor heat exchange device 10. RAZ285XE manufactured by Daikin Industries, Ltd. was used as the outdoor heat exchange device 18. R-22 was used as the refrigerant.

Next, as shown in FIG. 1, the refrigeration air conditioning system 1 serving as an air conditioner was operated. Specifically, after it was operated for 30 minutes, it was stopped for 10 minutes, and it was then restarted. The power consumption per hour of the compressor 16 was measured with the measurement instrument (Watt Checker (watt meter) DW-777 manufactured by Edenki Co.) at 7 minutes after the operation was restarted. The result was as follows.

Power consumption per hour of the compressor: 900 Wh/h Moreover, after 7 minutes had passed after operation was restarted, the power consumption per hour of the compressor 16 was maintained about 885 Wh/h.

Comparative Example 1-2

The refrigeration air conditioning system was prepared in the same way as in Example 1-2 except that the linear groove 119 was not formed in the pipe 114. The refrigeration air conditioning system 1 serving as the air conditioner was operated under the same conditions as in Example 1-2. Specifically, after it was operated for 30 minutes, it was stopped for 10 minutes, and it was then restarted. The power consumption per hour of the compressor was measured with the measurement instrument (Watt Checker (watt meter) DW-777 manufactured by Edenki Co.) at 7 minutes after the operation was restarted. The result was as follows.

Power consumption per hour of the compressor: 969 Wh/h

Results

As described above, the measurement results of Example 1-1 indicate that the low pressure operation was maintained, the refrigerant was likely to be liquefied, and the indoor air conditioning capability was improved compared to those obtained by Comparative Example 1-1. In addition, compared to Comparative Example 1-1, Example 1-1 reduced the power consumption per hour of the compressor by approximately 32.9%, indicating significant contribution to energy saving. Furthermore, compared to Comparative Example 1-2, Example 1-2 reduced the power consumption per hour of the compressor by approximately 69 Wh/h (6.25%) due to the presence of the linear groove 119, indicating further contribution to energy saving.

Example 2

The present invention will be described in more detail based on Examples 2-1 and 2-2 and Comparative Examples 2-1 and 2-2. However, the present invention is not limited to the following examples.

Example 2-1

First, the refrigeration air conditioning system 1 according to this embodiment was prepared. FZ285X manufactured by Daikin Industries, Ltd. was used as the indoor heat exchange device 10. RAZ285XE manufactured by Daikin Industries, Ltd. was used as the outdoor heat exchange device 18. R-22 was used as the refrigerant.

Next, as shown in FIG. 2, the refrigeration air conditioning system 1 serving as heating device for 60 minutes under the following conditions, as specified in JS C9612:

Indoor temperature: 20° C.

Indoor relative humidity: 53% RH

Outdoor air temperature: 7° C.

After the operation, the pressure at the inlet side of the compressor 16 (on the side of the indoor heat exchange device) and the pressure at the outlet side of the compressor 16 (on the side of the outdoor heat exchange device) were measured to obtain the following measurement results. Moreover, Power consumption per hour of the compressor 16 was measured with the measurement instrument (Watt Checker (watt meter) DW-777 manufactured by Edenki Co.) to obtain the following measurement results.

Pressure at the inlet side of the compressor (on the side of the indoor heat exchange device): 0.29 MPa Pressure at the outlet side of the compressor (on the side of the outdoor heat exchange device): 1.44 MPa Power consumption per hour of the compressor: 960 Wh/h After the operation, the refrigerant at the outlet of the outdoor heat exchange device 18 was fed to a heat-resistant glass level gauge, and illuminated by the LED (light-emitting diode) for visually checking the bubble in the refrigerant by using the liquid pipe side glass placed in the piping. No bubble was confirmed.

Comparative Example 2-1

The refrigeration air conditioning system was prepared in the same way as in Example 2-1 except that the refrigerant processing device 100 was not provided. The refrigeration air conditioning system 1 serving as the heating device was operated for 60 minutes under the same conditions as those of Example 2-1.

After the operation, the pressure at the inlet side of the compressor (on the side of the indoor heat exchange device), the pressure at the outlet side of the compressor (on the side of the outdoor heat exchange device), and power consumption per hour of the compressor were measured to obtain the following measurement results.

Pressure at the inlet side of the compressor (on the side of the indoor heat exchange device): 0.45 MPa Pressure at the outlet side of the compressor (on the side of the outdoor heat exchange device): 1.70 MPa Power consumption per hour of the compressor: 1590 Wh/h After the operation, the refrigerant at the outlet of the outdoor heat exchange device was fed to the heat-resistant glass level gauge, and illuminated by the LED (light-emitting diode) for visually checking the bubble in the refrigerant. The gaseous phase of approximately 15% was confirmed.

Example 2-2

The refrigeration air conditioning system 1 according to this embodiment was prepared. FZ285X manufactured by Daikin Industries, Ltd. was used as the indoor heat exchange device 10. RAZ285XE manufactured by Daikin Industries, Ltd. was used as the outdoor heat exchange device 18. R-22 was used as the refrigerant.

Next, as shown in FIG. 2, the refrigeration air conditioning system 1 serving as a heating device was operated under the following conditions, as specified in HS C9612:

Indoor temperature: 20° C.

Indoor relative humidity: 53% RH

Outdoor air temperature: 7° C.

Specifically, after it was operated for 30 minutes, it was stopped for 10 minutes, and it was then restarted. The power consumption per hour of the compressor 16 was measured with the measurement instrument (Watt Checker (watt meter) DW-777 manufactured by Edenki Co.) at 7 minutes after the operation was restarted. The result was as follows.

Power consumption per hour of the compressor: 1008 Wh/h Moreover, after 7 minutes had passed after the operation was restarted, the power consumption per hour of the compressor 16 was maintained about 960 Wh/h.

Comparative Example 2-2

The refrigeration air conditioning system was prepared in the same way as in Example 2-2 except that linear groove 119 was not fainted in the pipe 114. The refrigeration air conditioning system 1 serving as the heating device was operated under the same conditions as in Example 2-2. Specifically, after it was operated for 30 minutes, it was stopped for 10 minutes, and it was then restarted. The power consumption per hour of the compressor was measured with the measurement instrument (Watt Checker (watt meter)

DW-777 manufactured by Edenki Co.) at 7 minutes after the operation was restarted. The result was as follows.

Power consumption per hour of the compressor: 1048 Wh/h

Results

As described above, the measurement results of Example 2-1 indicate that low pressure operation was maintained, the refrigerant was likely to be liquefied, and the indoor heating capability was improved compared to those obtained by Comparative Example 2-1. In addition, compared to Comparative Example 2-1, Example 2-1 reduced the power consumption per hour of the compressor by approximately 39.6%, indicating significant contribution to energy saving. Furthermore, compared to Comparative Example 2-2, Example 2-2 reduced the power consumption per hour of the compressor by approximately 40 Wh/h (4.77%) due to the presence of the linear groove 119, indicating further contribution to energy saving.

REFERENCE SIGNS LIST

1 . . . Refrigeration air-conditioning system
10 . . . indoor heat exchange device
12 . . . three-way valve
14 . . . four-way valve
16 . . . compressor
18 . . . outdoor heat exchange device
19 . . . expansion valve
20 . . . capillary tubes
22 . . . two-way valve
24 . . . heat exchanger
100 . . . refrigerant processing device
110 main body
110*a* . . . chamber section
110*b* . . . upper end wall part
110*c* . . . lower end wall part
110*d* . . . barrel
110*e* . . . cylindrical coil spring
112 . . . narrow tube
114 . . . pipe part
114*a* . . . inner pipe part
114*b* . . . flow passage
116 . . . spiral groove (first spiral groove)
118 . . . spiral groove (second spiral groove)
119 . . . linear groove
120 . . . constricting member
120*a* . . . open hole
H1, H2 . . . openings

The invention claimed is:

1. A refrigerant processing device comprising:

a main body having a cylindrical body part, and an upper and lower end wall parts closing each end of the cylindrical body part; and a pipe and a narrow tube that feed a refrigerant into the main body and feed the refrigerant out of the main body, wherein the pipe passes through the lower end wall part, and extends along an axial direction of the cylindrical body part, wherein the narrow tube passes through the upper end wall part, wherein a first spiral groove extending in a spiral shape with respect to the axial direction is formed on an inner circumferential surface of the cylindrical body part, wherein a second spiral groove extending in a spiral shape with respect to the axial direction is formed on an outer circumferential surface of the pipe, and wherein at least one linear groove extending in the axial direction and intersecting the second spiral groove is formed on the outer circumferential surface of the pipe.

2. The refrigerant processing device according to claim 1, wherein a depth of the at least one linear groove is less than a depth of the second spiral groove.

3. The refrigerant processing device according to claim 1, wherein an inner end part of the narrow tube located inside the main body is bent, and wherein an opening of the inner end part is directed toward the inner circumferential surface of the cylindrical body part.

4. The refrigerant processing device according to claim 1, wherein the first spiral groove extends a whole length of the body part, and wherein a pitch of the first spiral groove at the upper end wall part is smaller than a pitch of the first spiral groove at the lower end wall part.

5. The refrigerant processing device according to claim 1, further comprising a coil spring installed along the inner circumferential surface of the cylindrical body part, wherein the first spiral groove is formed by a gap between adjacent metal wire portions of the coil spring.

6. The refrigerant processing device according to claim 1, wherein an opening of the narrow tube is offset from an opening of the pipe with respect to the axial direction of the cylindrical body part.

7. The refrigerant processing device according to claim 1, wherein the second spiral groove is a male screw formed on the outer circumferential surface of the pipe.

8. The refrigerant processing device according to claim 1, wherein at least one throttle having a smaller flow passage area than a flow path area of the pipe is provided within the pipe.

9. A refrigeration air conditioning system comprising:

an indoor heat exchange device;

a compressor to compress a refrigerant, wherein the compressor is connected to the indoor heat exchange device to transfer the refrigerant between the compressor and the indoor heat exchange device;

an outdoor heat exchange device that is connected to the compressor to transfer the refrigerant between the outdoor heat exchange and the compressor;

a refrigerant processing device according to claim 1 and that is connected to the outdoor heat exchange device to transfer the refrigerant between the refrigerant processing device and the outdoor heat exchange device; and an expander to expand the refrigerant, wherein the expander is connected to the refrigerant processing device to transfer the refrigerant between the expander and the refrigerant processing device, and wherein the expander is additionally connected to the indoor heat exchange device to transfer the refrigerant between the expander and the indoor heat exchange.

10. A refrigerant processing device comprising:

a cylindrical body configured to store refrigerant;

a first spiral groove formed on an inner circumferential surface of the cylindrical body and extending in a spiral shape with respect to an axial direction of the cylindrical body;

an upper wall part enclosing an upper end of the cylindrical body;

a lower wall part enclosing a lower end of the cylindrical body;

a pipe configured to transfer the refrigerant contained in the cylindrical body, wherein the pipe passes through the lower wall part and extends in the axial direction;

a second spiral groove formed on an outer circumferential surface of the pipe conduit and extending in a spiral shape with respect to the axial direction; and at least one linear groove formed on the outer circumferential surface of the pipe, the at least one linear groove extending in the axial direction and intersecting the second spiral groove.

11. The refrigerant processing device according to claim 10, wherein a depth of the at least one linear groove is shallower than a depth of the second spiral groove.

12. The refrigerant processing device according to claim 10, further comprising a tube configured to transfer the refrigerant contained in the cylindrical body, wherein the tube passes through the upper wall part.

13. The refrigerant processing device according to claim 12, wherein an inner end part of the tube located inside the cylindrical body is bent, and wherein an opening of the inner end part is directed toward the inner circumferential surface of the cylindrical body.

14. The refrigerant processing device according to claim 12, wherein an opening of the tube is offset from an opening of the pipe with respect to the axial direction of the cylindrical body.

15. The refrigerant processing device according to claim 12, wherein the tube is configured to transfer the refrigerant into the cylindrical body when the refrigerant processing device operates as a cooling device, and wherein the pipe is configured to transfer the refrigerant out of the cylindrical body when the refrigerant processing device operates as the cooling device.

16. The refrigerant processing device according to claim 12, wherein the tube is configured to transfer the refrigerant out of the cylindrical body when the refrigerant processing device operates as a heating device, and wherein the pipe is configured to transfer the refrigerant into the cylindrical body when the refrigerant processing device operates as the heating device.

17. The refrigerant processing device according to claim 10, wherein the first spiral groove extends an entire length of the cylindrical body, and wherein a pitch of the first spiral groove at the upper wall part is smaller than a pitch of the first spiral groove at the lower wall part.

18. The refrigerant processing device according to claim 10, further comprising a coil spring installed along the inner circumferential surface of the cylindrical body, wherein the first spiral groove is formed by a gap between adjacent metal wires of the coil spring.

19. The refrigerant processing device according to claim 10, wherein the second spiral grove is a male screw formed on the outer circumferential surface of the pipe.

20. The refrigerant processing device according to claim 10, wherein at least one throttle provided within the pipe has a smaller flow passage area than a flow path area of the pipe.

21. The refrigeration air conditioning system according to claim 9, wherein, when the refrigerant processing device is operated as a cooling device, the compressor is configured to receive the refrigerant from the indoor heat exchange device, the outdoor heat exchange device is configured to receive the refrigerant having been compressed, from the compressor, the refrigerant processing device is configured to receive the refrigerant from the outdoor heat exchange device, the expander is configured to receive the refrigerant from the refrigerant processing device, and the indoor heat exchange device is configured to receive the refrigerant having been expanded, from the expander.

22. The refrigeration air conditioning system according to claim 9, wherein, when the refrigerant processing device is operated as a heating device, the compressor is configured to receive the refrigerant from the outdoor heat exchange device, the indoor heat exchange device is configured to receive the refrigerant having been compressed, from the compressor, the expander is configured to receive the refrigerant from the indoor heat exchange device, the refrigerant processing device is configured to receive the refrigerant having been expanded, from the expander, and the outdoor heat exchange device is configured to receive the refrigerant from the refrigerant processing device.

* * * * *